US012529533B1

(12) United States Patent
Zeman

(10) Patent No.: US 12,529,533 B1
(45) Date of Patent: Jan. 20, 2026

(54) SYSTEM FOR DELAYED BLOW-BACK ACTION FIREARM

(71) Applicant: Bryan Zeman, Lake Havasu City, AZ (US)

(72) Inventor: Bryan Zeman, Lake Havasu City, AZ (US)

( * ) Notice: Subject to any disclaimer, the term of this patent is extended or adjusted under 35 U.S.C. 154(b) by 156 days.

(21) Appl. No.: 18/659,059

(22) Filed: May 9, 2024

(51) Int. Cl.
*F41A 3/82* (2006.01)
*F41A 3/44* (2006.01)
*F41A 3/72* (2006.01)
*F41A 5/02* (2006.01)

(52) U.S. Cl.
CPC ..... *F41A 3/44* (2013.01); *F41A 3/82* (2013.01); *F41A 5/02* (2013.01)

(58) Field of Classification Search
None
See application file for complete search history.

(56) References Cited

U.S. PATENT DOCUMENTS 1,464,276 A * 8/1923 Vincon ..... F41A 19/03 89/131
3,650,177 A * 3/1972 Hupp ..... F41A 19/03 89/198
4,057,003 A * 11/1977 Atchisson ..... F41A 9/68 89/142
7,055,422 B1 * 6/2006 Dindl ..... F41A 3/54 42/1.06
10,794,647 B2 * 10/2020 Lage ..... F41A 3/26
11,054,200 B1 * 7/2021 Cozad ..... F41A 3/84
11,549,769 B1 * 1/2023 Roth ..... F41A 5/12
11,692,785 B1 * 7/2023 Litzie ..... F41A 3/84 42/74
2010/0186581 A1 * 7/2010 Hajjar ..... F41A 3/46 89/188
2014/0230642 A1 * 8/2014 Reynolds ..... F41A 3/78 89/130
2018/0112939 A1 * 4/2018 Wheatley ..... F41A 3/72
2018/0266782 A1 * 9/2018 Bender ..... F41A 19/31
2019/0331443 A1 * 10/2019 Brown ..... F41A 3/12
2019/0383571 A1 * 12/2019 Wyssen ..... F41A 3/82
2020/0096268 A1 * 3/2020 Lage ..... F41A 3/66
2022/0146219 A1 * 5/2022 Noonan ..... F41A 5/30
2022/0299281 A1 * 9/2022 Li ..... F41A 3/78
(Continued)

*Primary Examiner* — Derrick R Morgan
(74) *Attorney, Agent, or Firm* — Wood Herron & Evans LLP

(57) ABSTRACT

Provided is a blow-back bolt and recoil spring/buffer system for an autoloading firearm action. The blow-back bolt includes a bolt body and an actuator that is longitudinally movable relative to the bolt body to a limited extent by manual cycling. The recoil spring/buffer system has a longitudinal guide rod with at least one recess, a release component and a forward abutment slidably arranged together on the guide rod, a recoil spring is configured to bias the release component forwardly, and at least one roller body is arranged between the release component and the forward abutment. When the roller body is engaged in the recess, the release component and forward abutment are longitudinally slidably detained relative to the guide rod. Rearward movement of the actuator by manual cycling engages and displaces the release component such that the roller disengages from the guide rod recess to allow undetained rearward sliding movement against the recoil spring.

24 Claims, 16 Drawing Sheets

(56) References Cited

U.S. PATENT DOCUMENTS

| | | | | |
|---|---|---|---|---|
| 2022/0341688 | A1* | 10/2022 | Kastrun | F41A 17/38 |
| 2023/0272989 | A1* | 8/2023 | McMinn | F41A 3/66 |
| | | | | 89/191.01 |
| 2023/0304765 | A1* | 9/2023 | Litzie | F41A 3/84 |
| 2025/0027732 | A1* | 1/2025 | Jonsson | F41A 3/78 |
| 2025/0146773 | A1* | 5/2025 | Puha | F41A 3/66 |
| 2025/0172361 | A1* | 5/2025 | Puha | F41A 3/84 |
| 2025/0271228 | A1* | 8/2025 | Underwood | F41A 3/62 |

* cited by examiner

SYSTEM FOR DELAYED BLOW-BACK ACTION FIREARM

TECHNICAL FIELD

This invention relates to a system that delays opening of a blow-back action in a firearm. More specifically, it relates to a system of a blow-back bolt and recoil spring/buffer that provides the benefits of delayed opening, such as by a roller lock system, while allowing manual cycling of the action with less required applied force.

BACKGROUND

Auto-loading (automatic and semiautomatic) firearms use a portion of the energy that propels the projectile through the barrel to automatically cycle the action. Cycling the action extracts, ejects, and rechambers another cartridge. Each of these systems has some means for delaying the opening of the breach until the chamber pressure has dropped to a safe level. Some systems, such as the standard AR-pattern firearm, use a bolt that remains mechanically locked to the barrel until rotated to release engaged locking lugs, allowing enough time to pass during the unlocking rotation for the chamber pressure to drop to a safe level before the breach opens.

Pistol caliber carbines may not produce sufficient pressure to cause the bolt to unlock by rotating and instead use a blow-back bolt that creates an unlocked breach. When the breach us unlocked, other means are relied on to delay opening of the breach. As the name implies, the bolt blows back under the pressure of the fired round. Blow-back firearm bolts are usually heavy, and a stiff recoil spring presses against them. The combination of a heavy bolt, heavy buffer, and/or stiff recoil spring causes the bolt to open slower because heavy objects are harder to push (requires overcoming the inertia of their mass).

Others have used mechanical delay systems, such as a roller delayed blow-back, which use the higher chamber pressure to displace one part before the bolt will move to open the breach after the chamber pressure drops. This provides a "semi-rigid lock" of the breach. For example, a "roller-lock" or "roller-delayed" system is shown in German Patent No. 2,326,527, published Mar. 24, 1974, a version of which is used in the well-known Heckler & Koch MP5 platform.

More recently, a roller delayed recoil spring and buffer system was developed particularly (but not exclusively) for use with pistol caliber carbines in the AR-pattern platform. U.S. Pat. No. 10,619,955 ("the '955 patent" or "the '955 system") shows a system that is used with a blow-back bolt and replaces the standard recoil spring and buffer and fits within the buffer extension tube. In the '955 system, initial movement of the bolt against the system requires a high lever of force to disengage a roller-type semi-rigid "lock-up." Once the high level of force overcomes the roller lock-up, the bolt moves against only the recoil spring, which requires significantly less force. However, manually cycling a so-equipped firearm requires application of the same significantly higher force to initiate movement of the bolt. This can be difficult for persons with less hand or arms strength to operate. Also, the high initial level of force that suddenly drops. Causes hand cycling to be less sooth or "jerky."

A system that provides the benefits of the roller delay without the disadvantage of difficult and less smooth hand cycling is needed.

SUMMARY OF THE INVENTION

The present invention provides a blow-back bolt in combination with a recoil spring/buffer system for an autoloading firearm action. It includes a blow-back bolt with a bolt body and an actuator. The actuator is longitudinally movable relative to the bolt body to a limited extent by manual cycling. It also includes recoil spring/buffer system having a longitudinal guide rod with at least one recess, a release component and a forward abutment slidably arranged together on the guide rod, a recoil spring on the guide rod configured to bias the release component forwardly, and at least one roller body arranged between the release component and the forward abutment. When the roller body is engaged in the guide rod recess, the release component and forward abutment are longitudinally slidably detained relative to the guide rod. Rearward sliding movement of the actuator by manual cycling engages and displaces the release component relative to the forward abutment such that the at least one roller disengages from the guide rod recess to allow undetained rearward sliding movement of the release component and forward abutment against the recoil spring.

The present invention's combination of a modified blow-back bolt and recoil spring/buffer system operates virtually identical to the '955 system when the action cycles after a round is discharged, but it operates significantly different from the '955 system when hand cycled with the charging handle. Initial rearward movement of the charging handle unlocks the roller engagement in a first stage, and then, in a second stage of movement, moves the bolt. Both stages of hand cycling movement are resisted only by the recoil spring and use a consistent amount of force. Embodiments for a standard rear charging handle and for a side charging handle are shown.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
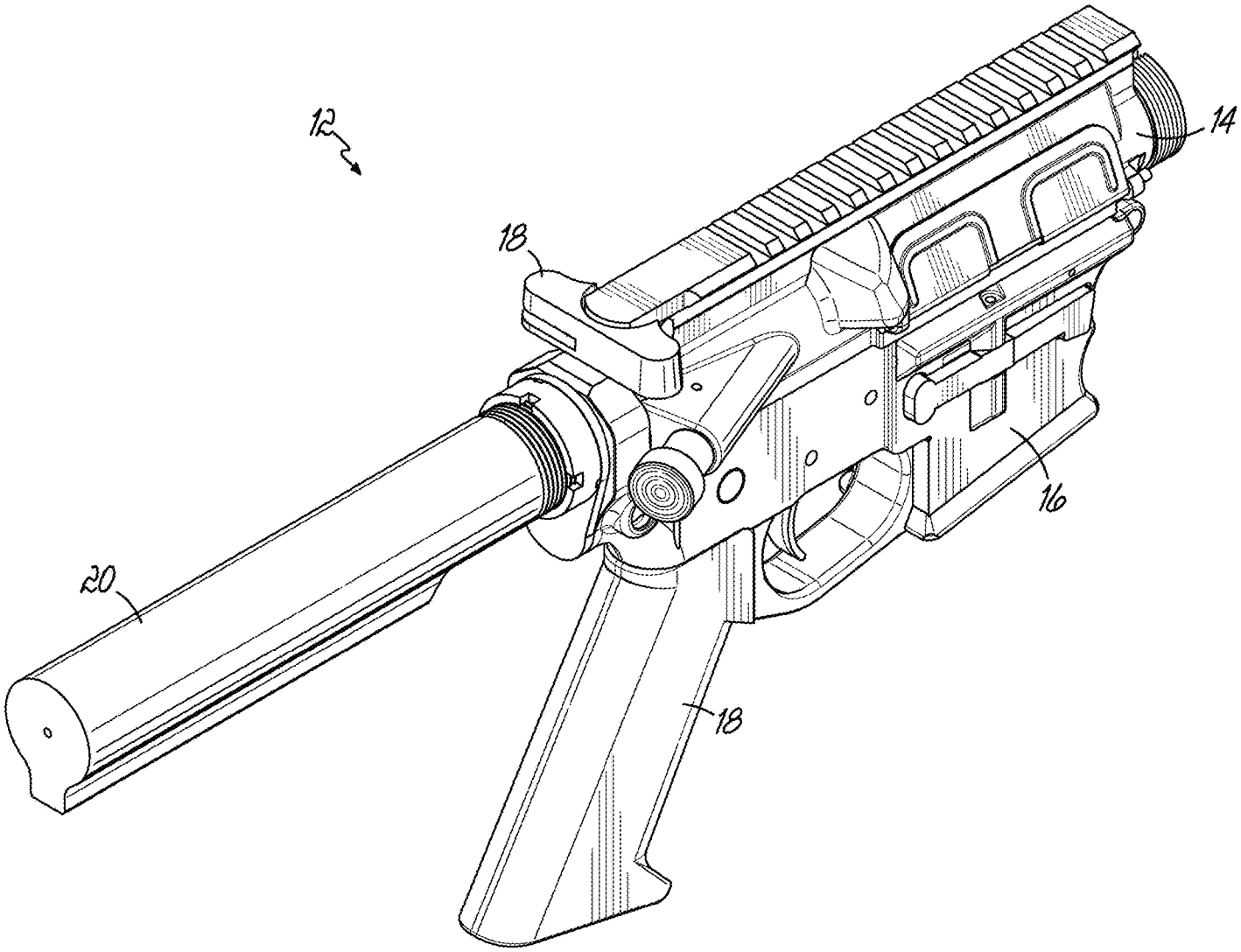
FIG. 1 is an isometric view of the exterior of an AR-pattern upper and lower receiver with buffer extension tube.
Figure 2:
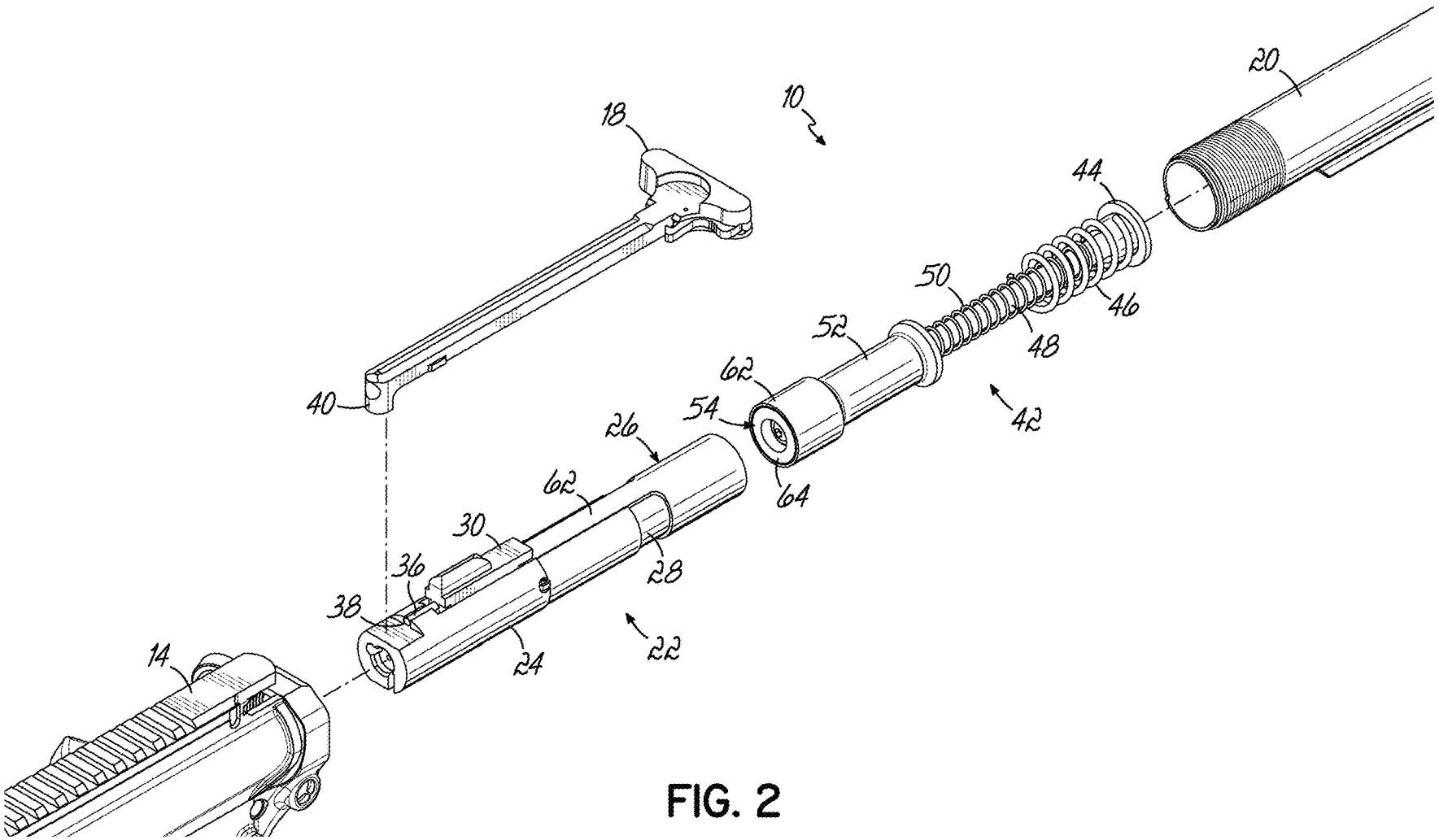
FIG. 2 is an isometric exploded view of a blow-back bolt and recoil spring/buffer system according to one embodiment of the present invention relative to a charging handle and rear portion of an upper receiver (barrel and handguard omitted)
Figure 3:
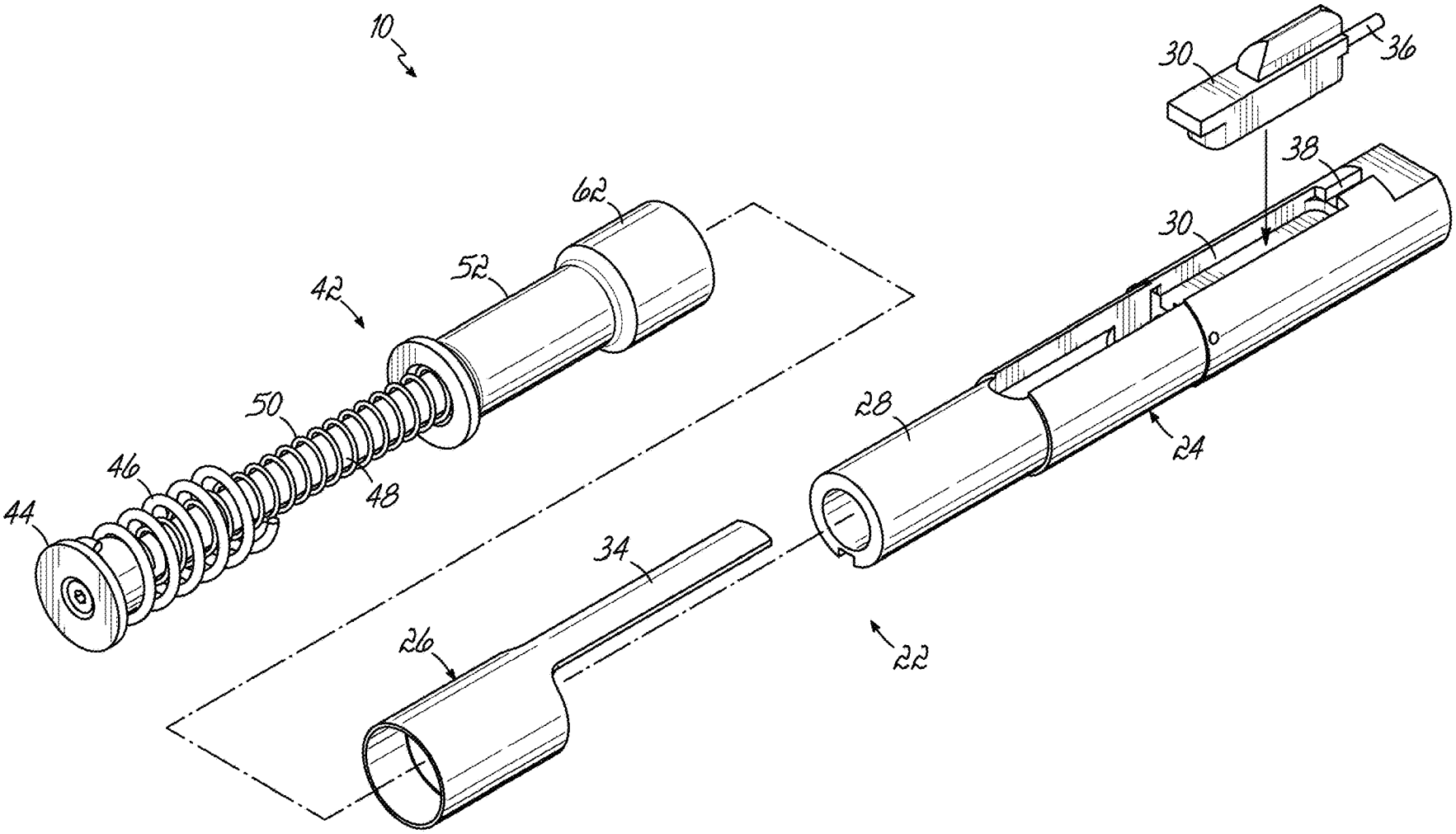
FIG. 3 is an opposite isometric exploded view of the blow-back bolt and recoil spring/buffer system.
Figure 4:
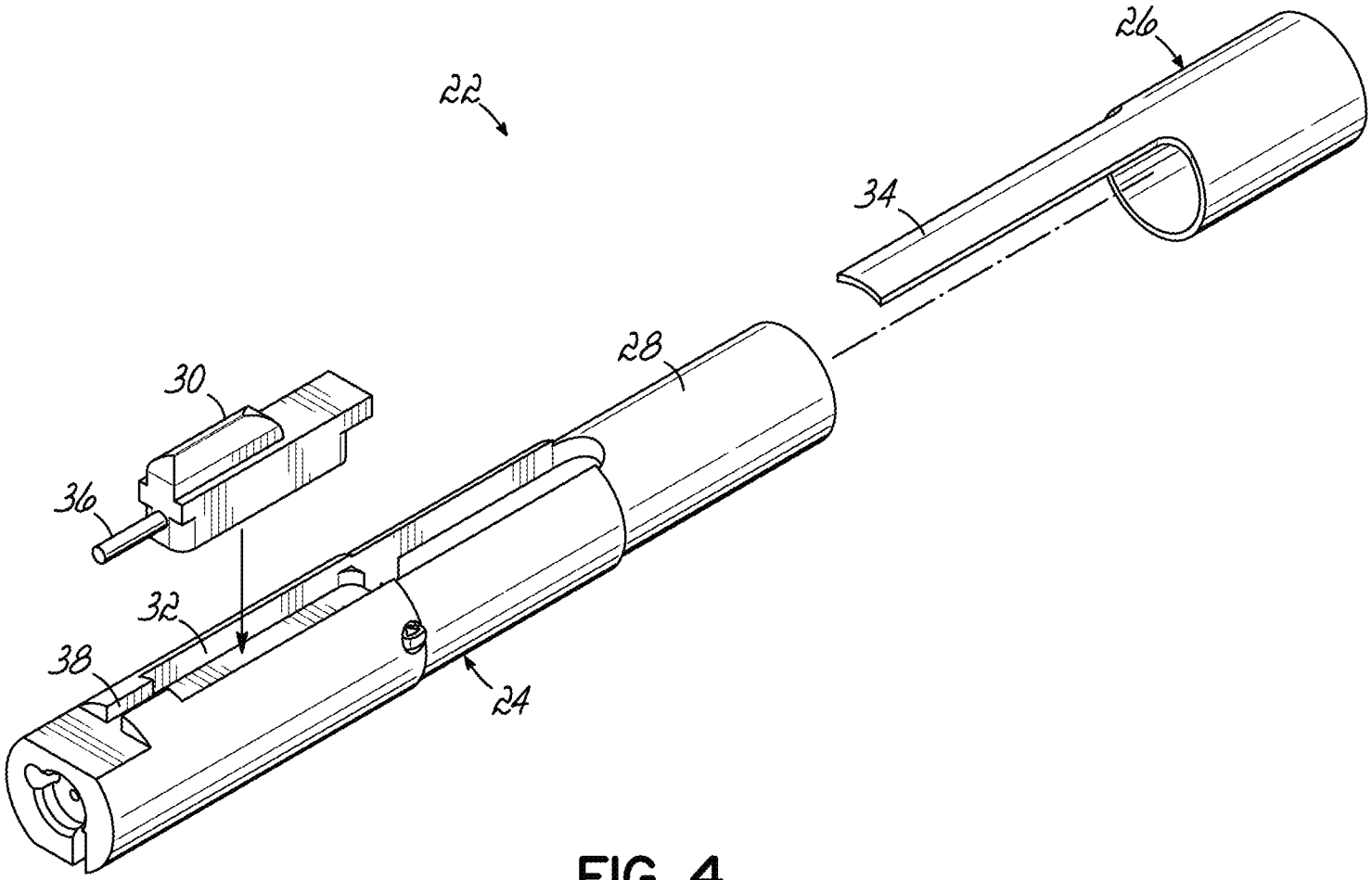
FIG. 4 is an isometric exploded view of the blow-back bolt.
Figure 5:
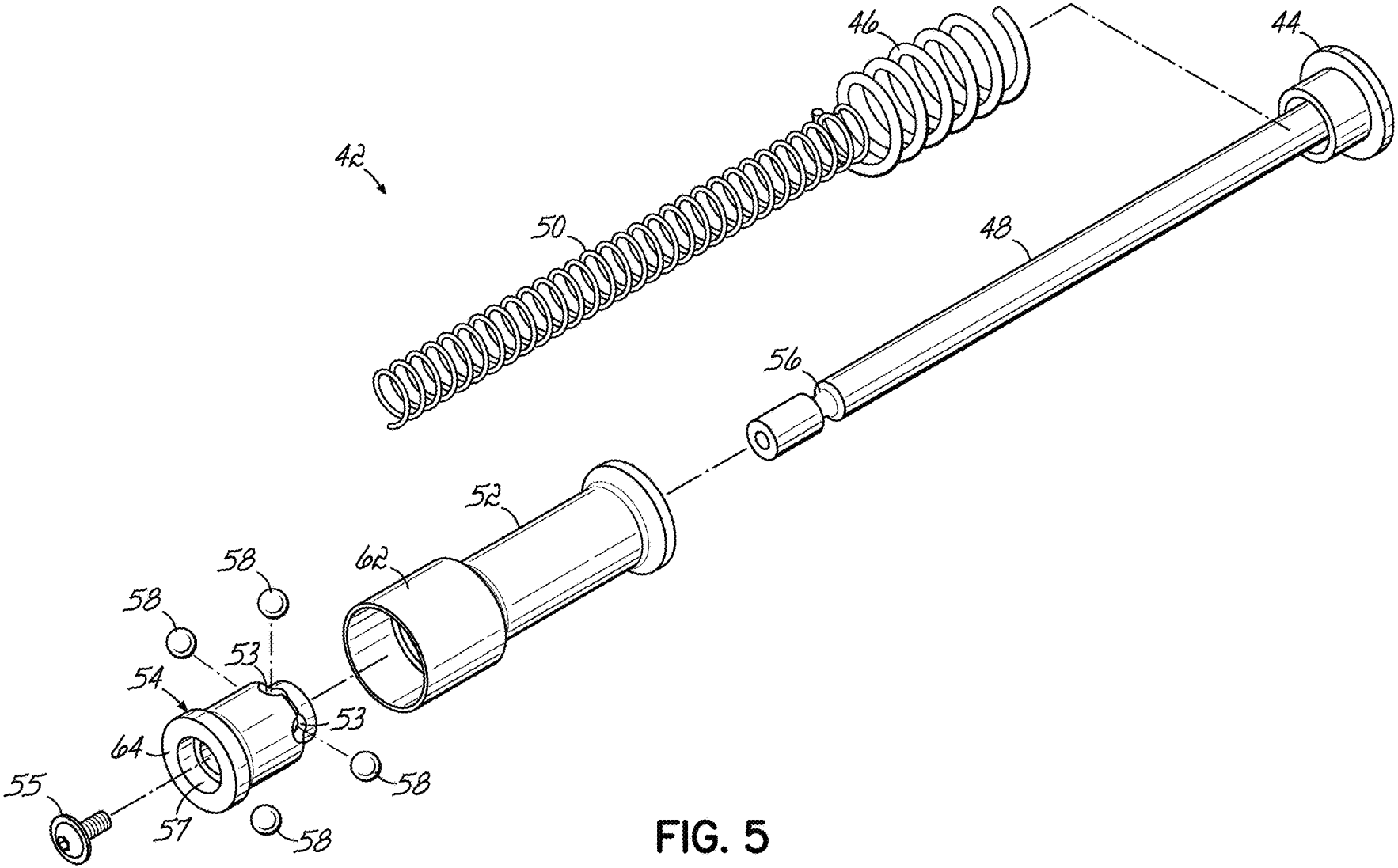
FIG. 5 is an isometric exploded view of the recoil spring/buffer system.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown, not described in detail, or not illustrated to scale to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Familiarity with the recoil spring/buffer system shown in U.S. Pat. No. 10,619,955 ("the '955 system" or "the '955 patent") is important to understanding the present invention. The entire disclosure of the '955 patent is incorporated herein by reference. The '955 system provides a roller delay to a standard blow-back bolt in an AR-pattern pistol caliber carbine. Following discharge of a cartridge, the '955 roller delay system requires a significantly higher amount of initial force (corresponding to higher chamber pressure) to begin rearward movement as the rollers are unseated to unlock the recoil spring/buffer system with no lost motion, followed by a suddenly significantly lower amount of force being required to continue movement and spring compression as the bolt cycles to the rear. FIG. 6 of the '955 system patent shows a force-displacement graph comparing the force curve of a standard unlocked blow-back bolt with one in which the '955 system is used. This advantageously delays opening of the breach until the chamber pressure reaches a higher level, but then allows lower pressure (force) to continue the cyclic movement. Disadvantageously however, a similarly high amount of force is required to begin initial rearward movement of the bolt when it is cycled by hand using the charging handle. This can make operation very difficult for those with less hand/arm strength. Additionally, the sudden drop in required force after initial movement makes the hand cycling operation less smooth for anyone. The present invention provides the roller delayed benefits of the '955 system without the accompanying disadvantages.

The present invention's combination of a modified blow-back bolt and recoil spring/buffer system operates virtually identical to the '955 system when the action cycles after a round is discharged but operates significantly different from the '955 system when hand cycled with the charging handle. When a round is discharged, the rear end of the bolt is pushed against the forward face of an abutment with the rollers between a release component and the abutment acting as a detent seated in a recess on the guide rod. When the force reaches an adequately high level, the detent is overcome by forcing the rollers out of the recess to allow the bolt to retract against only the relatively lower force of a main recoil spring. However, initial rearward movement of the charging handle unlocks the roller engagement in a first stage and then, in a second stage of movement, moves the bolt. Both stages of hand cycling movement are resisted only by the recoil spring and use a consistent amount of force, as explained below.

The present system 10 is suitable for AR-pattern pistol caliber carbines but can be advantageously used with certain rifle caliber cartridges, such as 0.300 Blackout (in both supersonic and subsonic loads) and FN 5.7×28 mm NATO.

Referring first to FIGS. 1-5, therein is shown a modified blow-back bolt and recoil spring/buffer system 10 according to a first embodiment of the present invention The illustrated embodiment is configured for use in an AR-pattern pistol caliber carbine firearm 12, although it can be configured for other calibers or other platforms. The location of all controls (i.e., manual of arms) is unchanged. No modification is required to the standard upper and lower pistol caliber carbine receivers 14, 16, standard charging handle 18, or standard receiver extension tube 20 (also known as a buffer tube).

The blow-back bolt 22 includes a main body 24 with a longitudinally slidable annular operating sleeve 26 at its rearward end. The sleeve 26 can fit on a reduced diameter portion 28 at the rear of the bolt body 24. An actuator 30 that engages with the charging handle 18 is slidably received in a slot 32 of the top of the bolt body 24 and also engages an operating extension 34 of the sleeve 26. The slot 32 limits the longitudinal travel of the actuator 30 relative to the bolt body 24. A forward extension 36 of the actuator 30 can be guided by an upper channel 38 to engage the hook 40 of the charging handle 18. Thus, when the charging handle 18 is manually retracted, it slides the actuator 30 rearward, limited in travel by the length of the slot 32. Movement of the actuator 30, in turn, pushes the sleeve 26 rearward via the operating extension 34. Once the actuator 30 has reached its limit of travel, further retraction of the charging handle 18 causes the entire bolt 22 to retract in the usual manner. The "lost motion" connection between the actuator 30 and bolt body 24 causes the sleeve 26 to move rearward a selected distance (D) prior to movement of the bolt body 24 when manually retracted by the charging handle 18. However, when the bolt body 24 is forced rearward as a result of discharging a cartridge, the bolt body 24, actuator 30, and sleeve 26 move in unison.

The recoil spring/buffer system 42 includes an end member 44 at the rear that supports an end-of-stroke buffer spring 46 and a central guide rod 48, which supports a main recoil spring 50. The forward end of the recoil spring 50 bears against a control piece or release component 52 that slides on the guide rod 48 along with a forward abutment 54. The recoil spring/buffer system 42 can be held together as a unit by, for example, a threaded fastener 55 received in a recess 57 in the face 64 of the forward abutment 54. Adjacent its forward end, the guide rod 48 has one or more recesses or an annular recess 56 (shown) that receives one or more roller bodies, which can be, for example, spherical or cylindrical rollers 58. The release component 52 and forward abutment 54 interact with the rollers 58 to semi-rigidly lock together and in place at the forward end of the guide rod 48 when the rollers 58 are seated in the recess 56. The abutment can have pockets 53 to receive the rollers 58. The spherical or cylindrical rollers are captured on/in recess 53 but are free to move radially. The release component 52 has one or more pockets or an annular pocket 60 (shown in FIGS. 8A-8C) on an inner surface configured such that, when the rollers 58 are displaced from the guide rod recess 56 into the pocket 60, the release component 52 and forward abutment 54 are released relative to the guide rod 48 and can slide longitudinally to the rear against only the force of the main recoil spring 50. As the main recoil spring 50 is compressed and the release component 52 and forward abutment 54 approach the end of their rearward cycle, the release component 52 will engage and compress the end-of-stroke buffer spring 46, which may require significantly greater force to compress than does the main recoil spring 50.

In contrast to the '955 system, the release component 52 of the present invention includes an extension 62 forward toward the forward face of the forward abutment. In the illustrated embodiment, the extension 62 is an annular sleeve or skirt that extends around the forward abutment 54 to a longitudinal position substantially even with the face 64 of the forward abutment 54. Benefits of the present invention are accomplished by longitudinal alignment of the forward extension 62 of the release component 52 and the sleeve 26 of the blow-back bolt 22, as shown in FIGS. 6A-C, 7A-C, and 8A-C and further explained below.

Figure 6A:
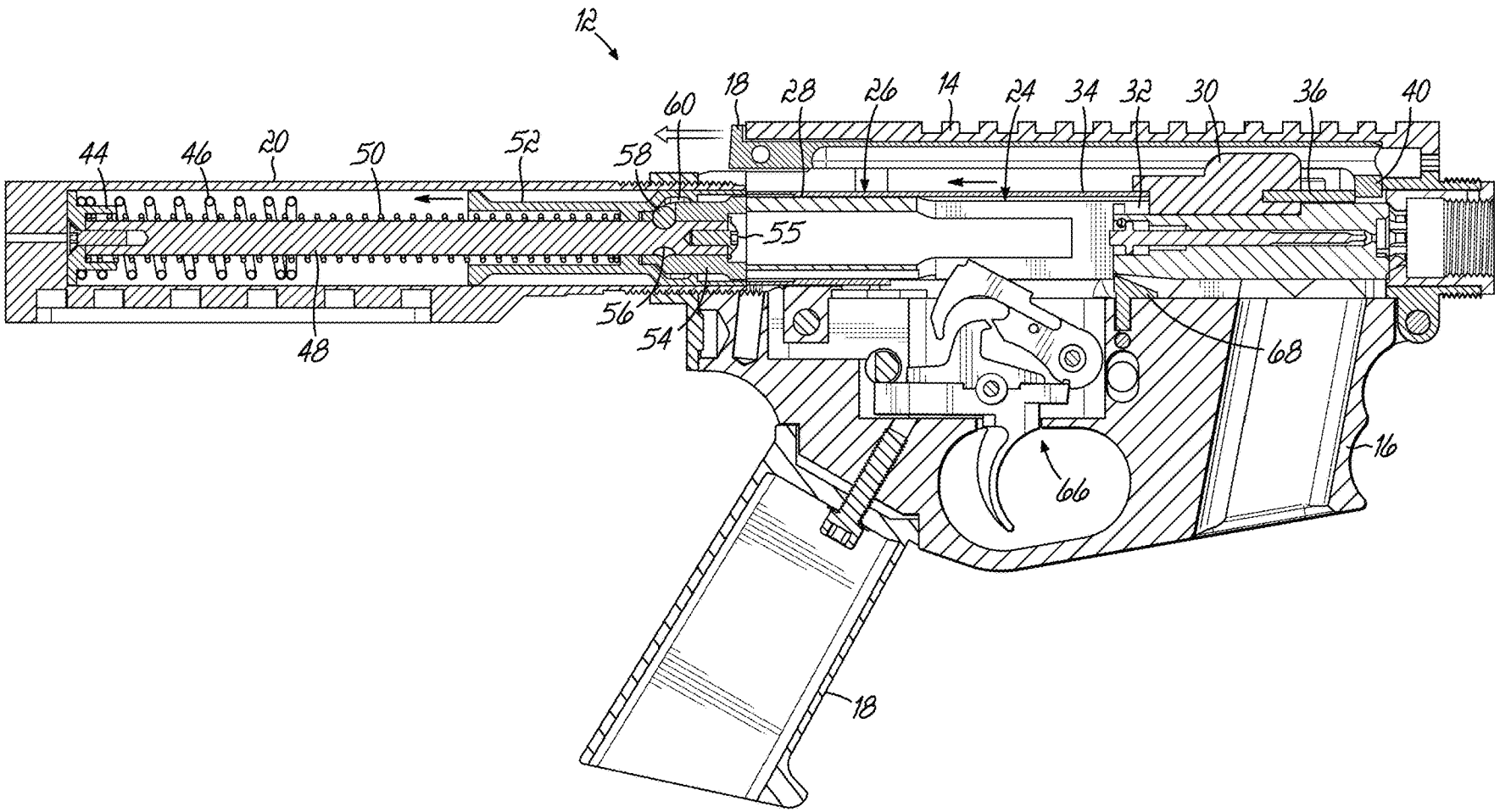
FIG. 6A is a side sectional view showing an embodiment of the blow-back bolt and recoil spring/buffer system in an in-batter position installed in upper and lower receivers of an AR-pattern pistol caliber carbine.
Figure 7A:
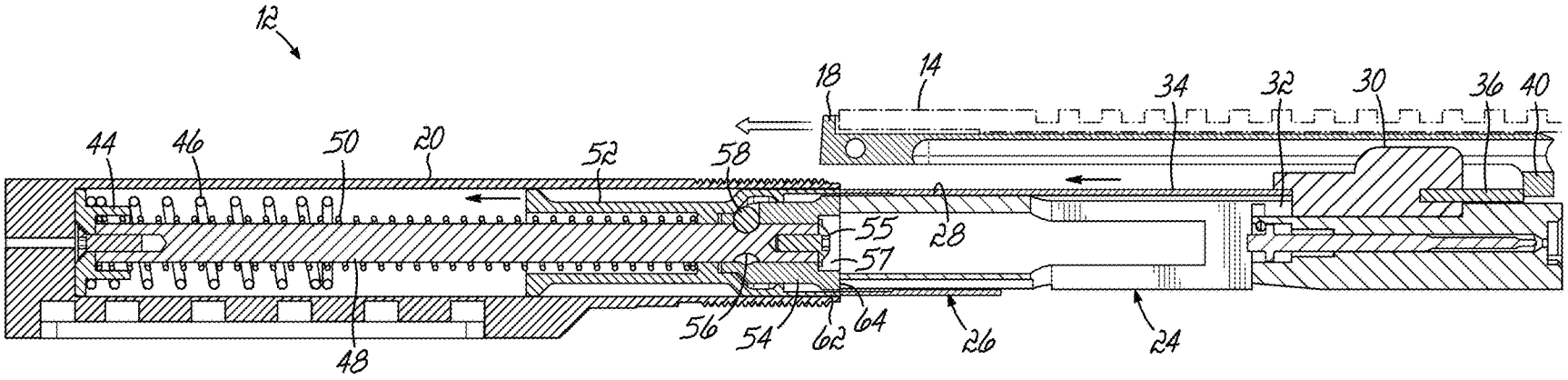
FIG. 7A is a side sectional view showing the charging handle, buffer extension tube, blow-back bolt and recoil spring/buffer system in isolation (upper and lower receivers removed) in positions corresponding to that of FIG. 6A.
Figure 8A:
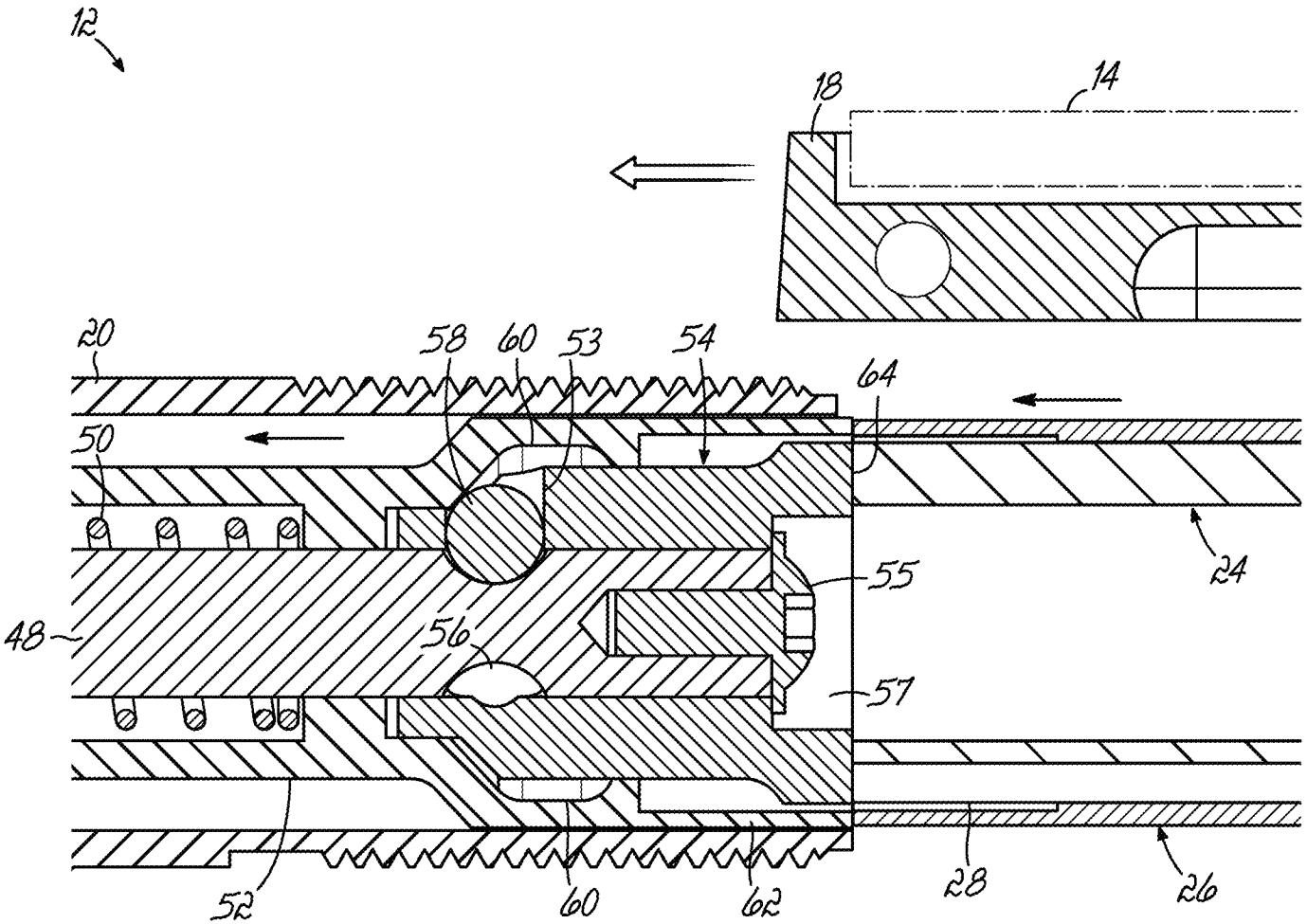
FIG. 8A is an enlarged side sectional view showing in detail the interaction between the bolt sleeve and recoil spring/buffer system corresponding to that of FIGS. 6A and 7A.

Referring first to FIGS. 6A, 7A, and 8A, therein is shown the blow-back bolt 22 and recoil spring/buffer system 42 of the present invention in AR-pattern upper and lower receivers 14, 16 in the in-battery or "at rest" position with the trigger mechanism 66 cocked. As previously noted, when a cartridge (not shown) is fired and the propellant force pushed the blow-back bolt 22 rearward, the operation of the blow-back bolt 22 and recoil spring/buffer system 42 is substantially identical to that of the '955 system. However, when the charging handle 18 is manually retracted to cycle the blow-back bolt 22 and recoil spring/buffer system 42 by hand (as depicted by arrows in FIGS. 6A, 7A, and 8A), the system 10 of the present invention operates significantly different.

Figure 6B:
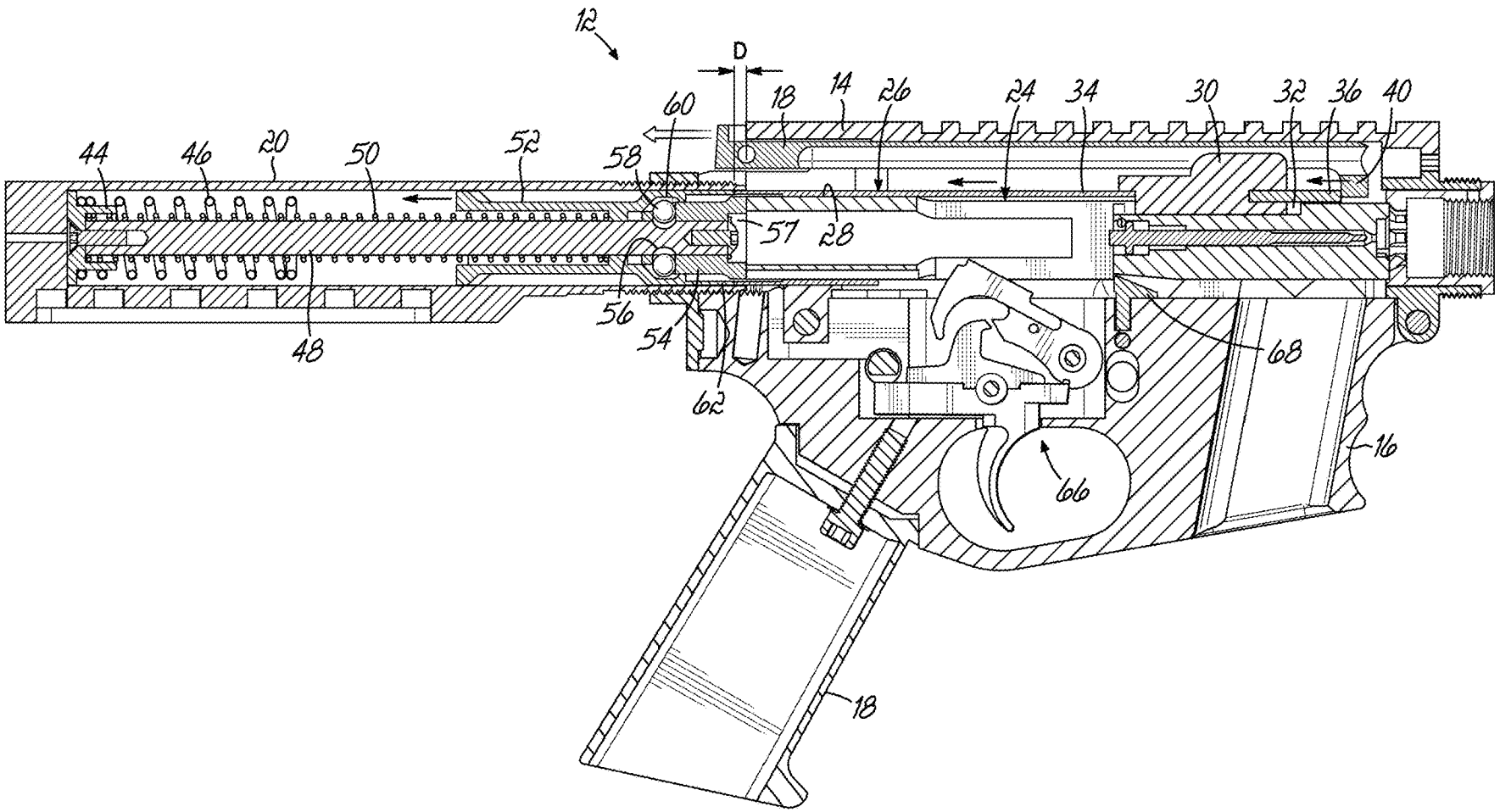
FIG. 6B is a similar view showing the first stage of charging handle retraction that rearwardly displaces the bolt sleeve without movement of the bolt body to unlock the recoil spring/buffer system prior to further or full retraction.
Figure 7B:
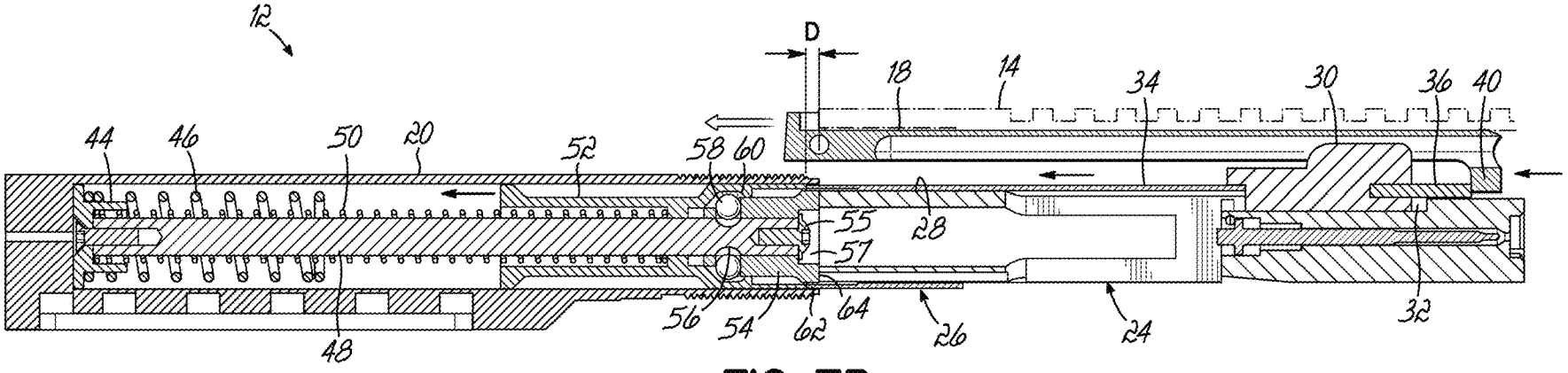
FIG. 7B is a similar view showing the first stage of charging handle retraction that rearwardly displaces the bolt sleeve without movement of the bolt body to unlock the recoil spring/buffer system prior to further or full retraction in positions corresponding to that of FIG. 6B.
Figure 8B:
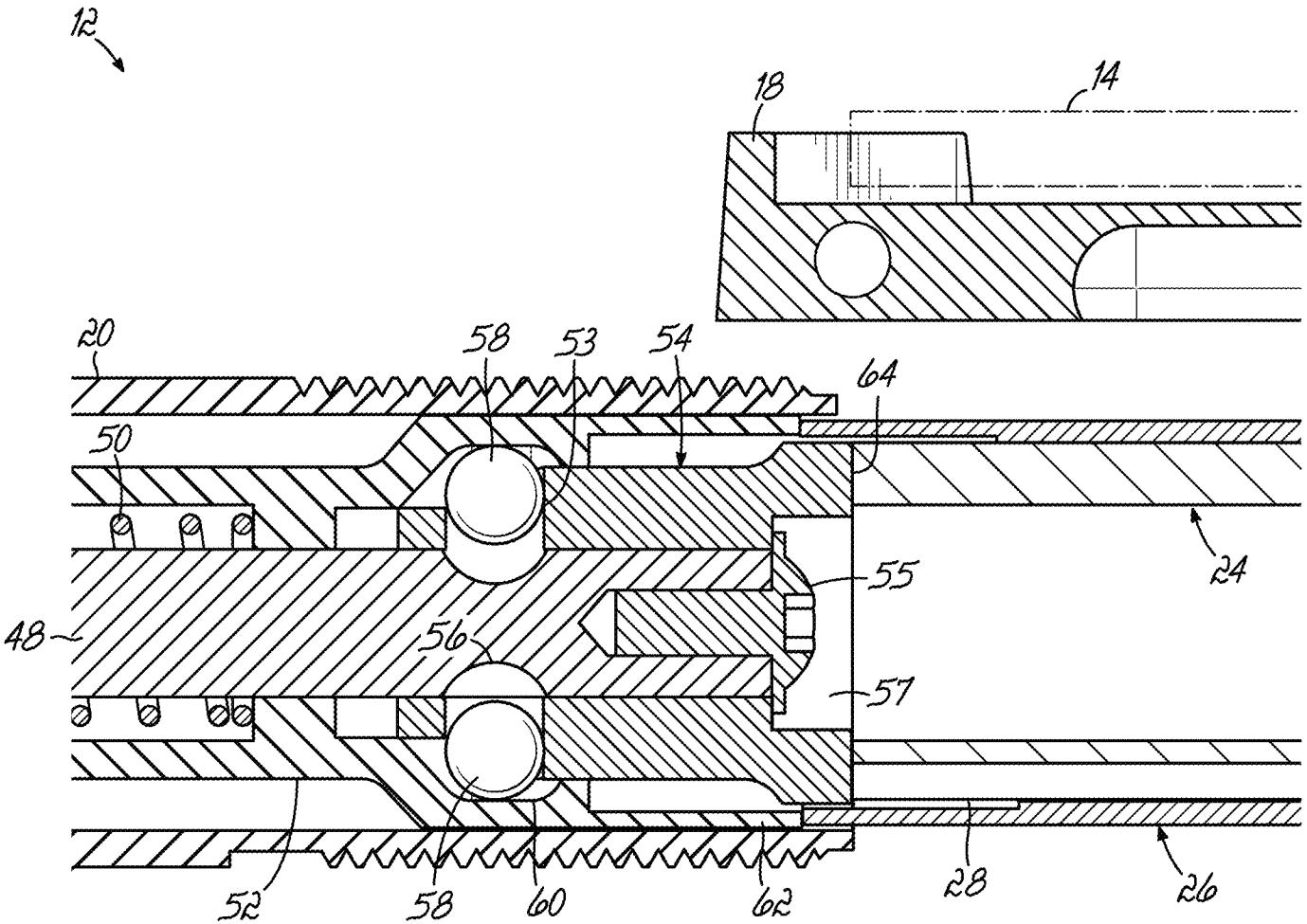
FIG. 8B is a similar view showing the interaction between the bolt sleeve and recoil spring/buffer system corresponding to that of FIGS. 6B and 7B.
Figure 8C:
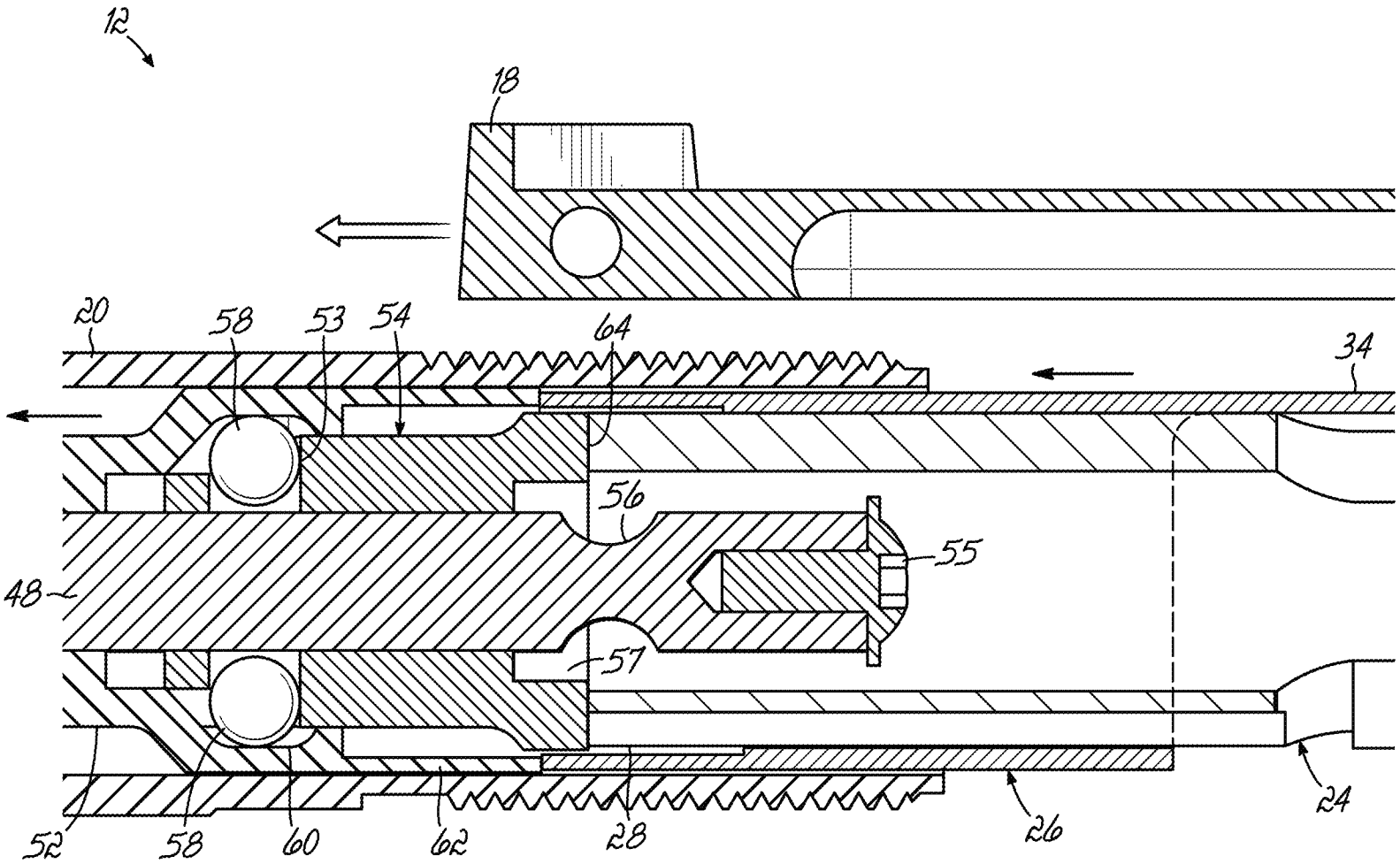
FIG. 8C is a similar view showing the interaction between the bolt sleeve and recoil spring/buffer system as they are further retracted.

As shown in FIGS. 6B, 7B, and 8B, as the charging handle 18 is manually retracted a first distance D (for example, about 0.100 to 0.200 inches), the charging handle 18 pulls against the actuator 30 on the bolt 24 and displaces it rearward in the slot 32 without longitudinally displacing the bolt body 24. This, in turn, causes the sleeve 26 to move rearward against the extension skirt 62 of the release component 52, resisted only by the force of the main recoil spring 50. This rearward displacement of the release component 52, without corresponding displacement of the forward abutment 54, allows the rollers 58 to shift from the recess 56 in the guide rod 48 to the pocket 60 inside the release component 52 (FIGS. 6B, 7B, and 8B), releasing the recoil spring/buffer system 42 from its semi-rigid lock-up state (FIGS. 6A, 7A, and 8A). Thus, the roller locking feature is disengaged during manual cycling using only the force necessary to compress the main recoil spring 50, in contrast to the significantly greater force required to dislodge the rollers 58 by instead initially pressing against the forward abutment 54 during the firing sequence.

Figure 6C:
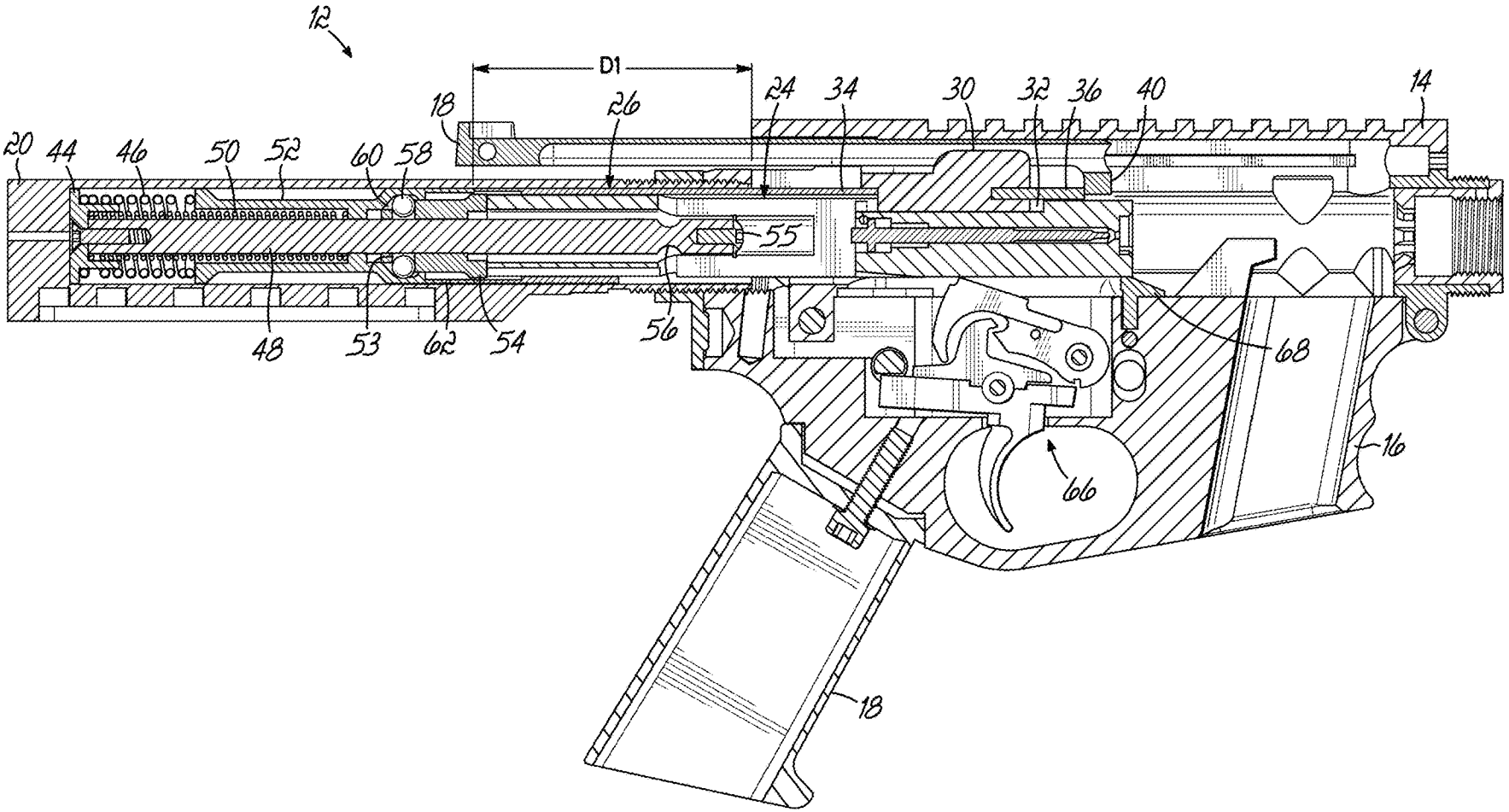
FIG. 6C is a similar view showing the blow-back bolt fully retracted and fully compressing the recoil spring.
Figure 7C:
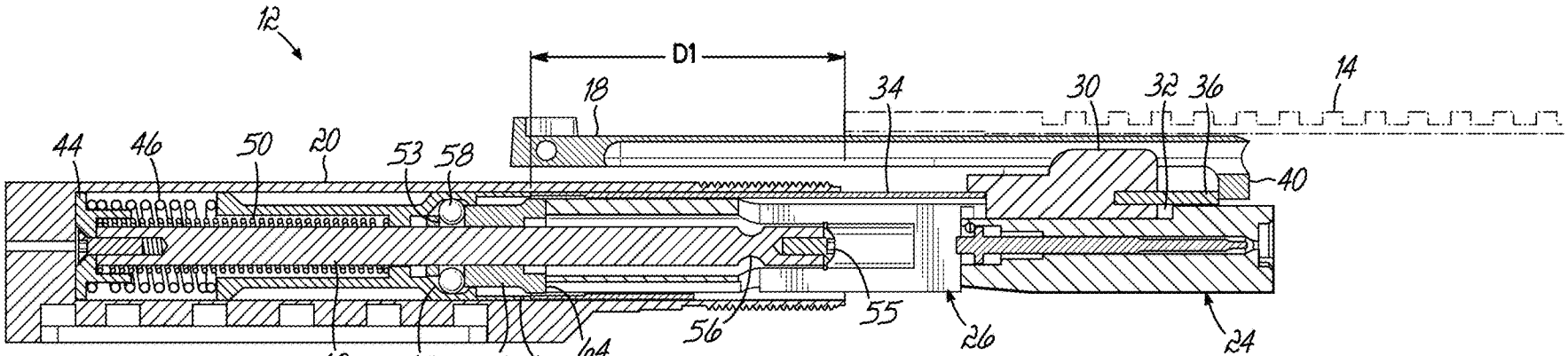
FIG. 7C is a similar view showing the blow-back bolt fully retracted and fully compressing the recoil spring in positions corresponding to that of FIG. 6C.

As the charging handle 18 is pulled to the full rearward stroke position a distance D1 (shown in FIGS. 60, 7C, and 8C), the main recoil spring 50 and, eventually, the buffer spring 46 are compressed. As shown in FIGS. 6C and 7C, the guide rod 48 will extend into and received by the longitudinally hollow rear portion of the bolt body 24 without interference. At this position, the bolt 22 can be locked back by engaging the bolt catch 68, or the charging handle 18 can be released, allowing the recoil spring 50 to drive the release component 52, forward abutment 54, and bolt assembly 22 forward toward battery. As the bolt 22 reaches the in-battery position, stopped by contact against the barrel (not shown), continued force of the recoil spring 50 against the release component 52 forces the rollers 58 back into the recess 56 of the guide rod 48 and forces the sleeve 26, actuator 30, and charging handle 18 back to their forwardmost position (as shown in FIGS. 6A, 7A, and 8A). If a loaded magazine (not shown) is in the magazine well, a cartridge is stripped from the magazine and chambered.

In a blow-back bolt system, the total moving mass as the action cycles during the firing sequence will affect the cyclic speed, reliability, and longevity (due to impact wear) of the action. Thus, in addition to varying the recoil spring strength and bolt mass, the mass of the release component 52 can be selected depending on, for example, the type or caliber of ammunition being used, the cartridge propellant load, and/or the barrel length.

Figure 9:
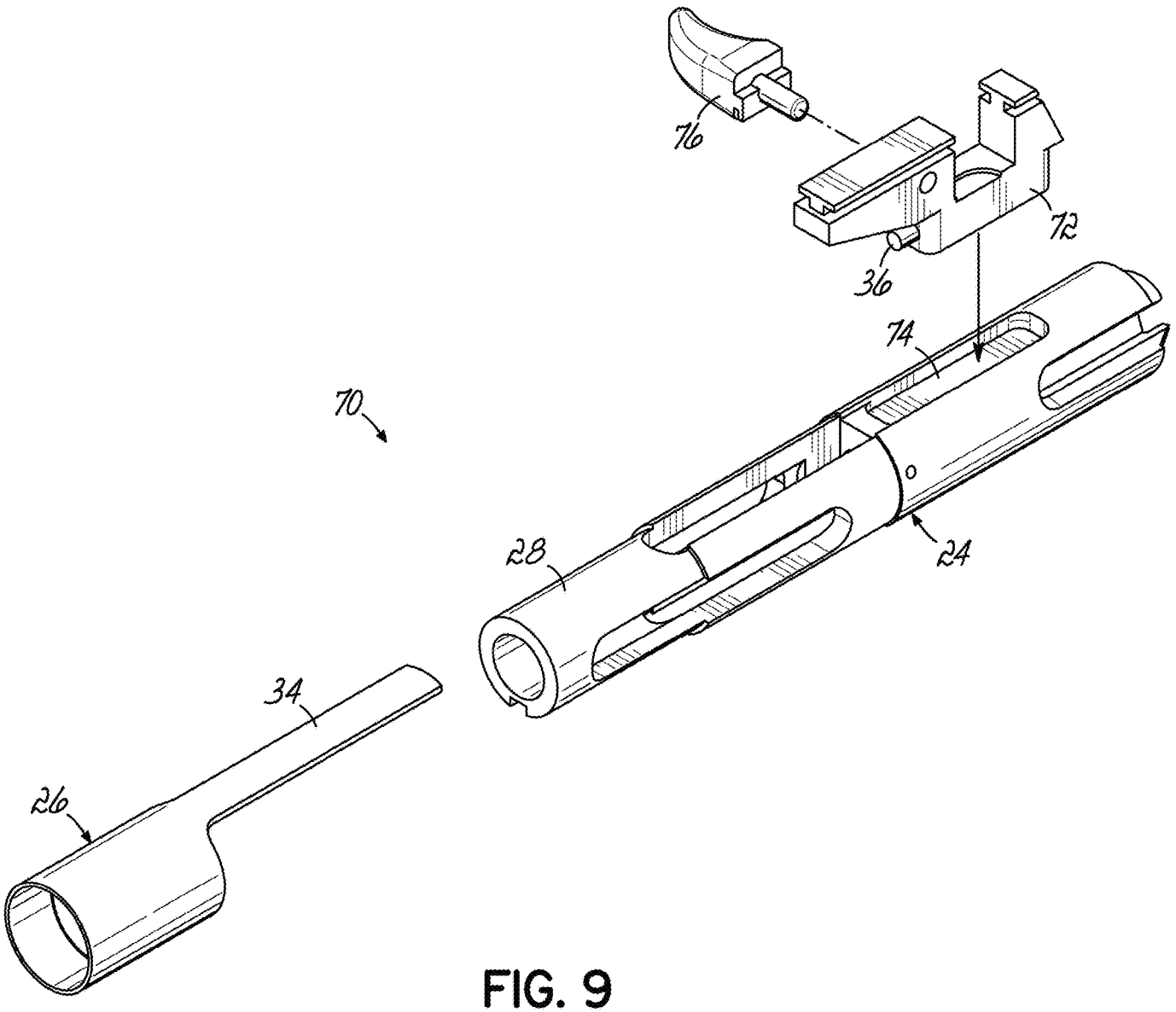
FIG. 9 is an isometric exploded view of an alternate embodiment blow-back bolt that provides a side charging handle.
Figure 10:
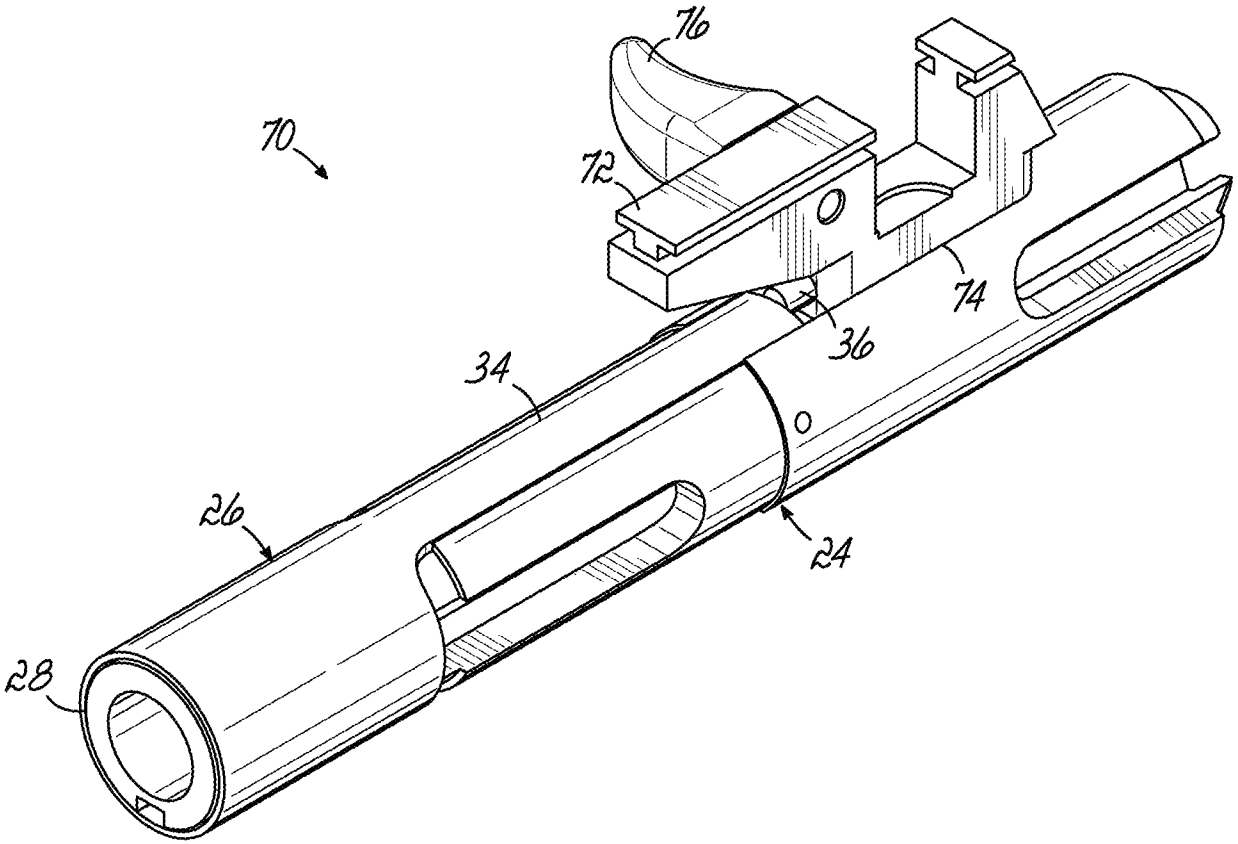
FIG. 10 is an assembled isometric view thereof.
Figure 11:
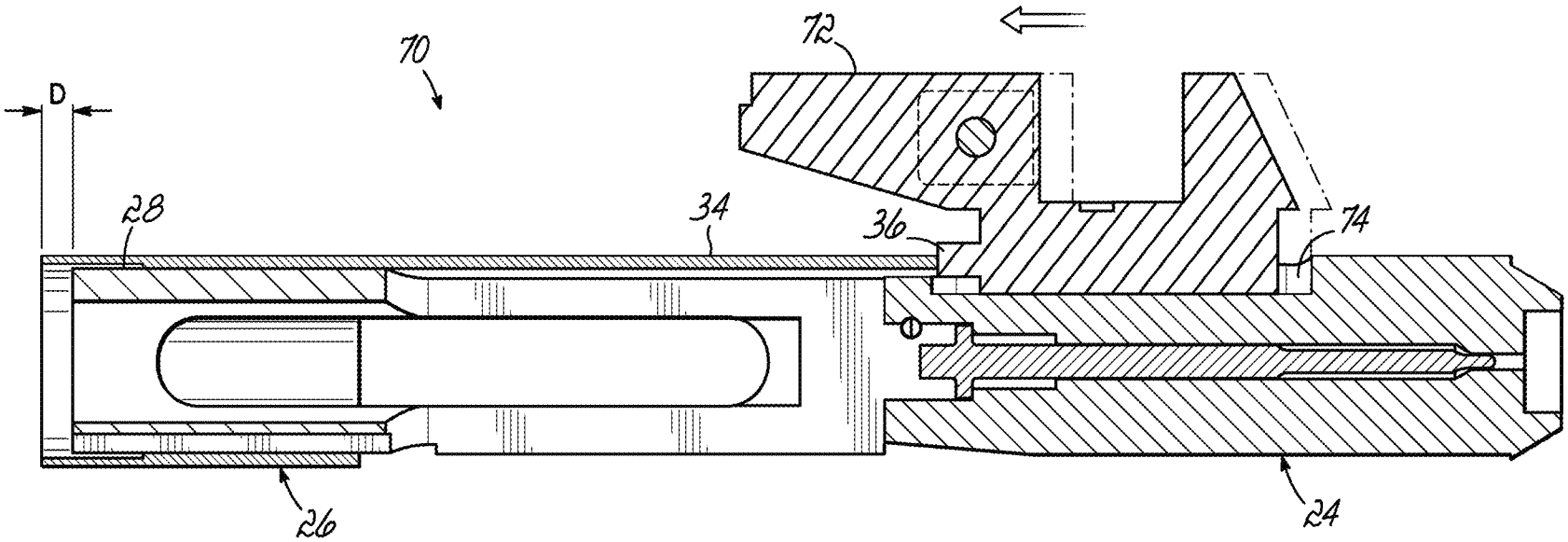
FIG. 11 is a side sectional view thereof showing rearward displacement of the handle and bolt sleeve.

FIGS. 9-11 show an alternate embodiment blow-back bolt 70 for use in the system of the present invention that provides a side charging handle, but otherwise functions like the previously described, rear charging handle embodiment. This embodiment is used with a modified upper receiver (not shown) that includes an elongated longitudinal opening in one or both sides for the side charging handle to reciprocate. The bolt body 24*a* and sleeve 26*a* are similar in form and function to those described above. Likewise, the actuator 72 is similar in function and is allowed limited longitudinal motion relative to the bolt body 24*a* in a top slot 74. Unlike the actuator 30 engaged by a rear charging handle 18, this actuator 72 is controlled by a charging lever 76 that extends laterally and reciprocates with the bolt body 24*a* during firing sequence firing. If desired, a lever 76 can extend to both the right and left sides, or it may be moved from one side to the other by the user.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A blow-back bolt and recoil spring/buffer system for an autoloading firearm action, comprising:

a blow-back bolt having a bolt body and an actuator, the actuator being longitudinally movable relative to the bolt body to a limited extent by manual cycling; and a recoil spring/buffer system comprising:

a longitudinal guide rod having at least one recess;

a release component and a forward abutment slidably arranged together on the guide rod;

a recoil spring on the guide rod configured to bias the release component forwardly; and at least one roller body arranged between the release component and the forward abutment such that when the roller body is engaged in the guide rod recess, the release component and forward abutment are longitudinally slidably detained relative to the guide rod, wherein rearward sliding movement of the actuator by manual cycling causes displacement of the release component relative to the forward abutment such that the at least one roller disengages from the guide rod recess to allow undetained rearward sliding movement of the release component and forward abutment against the recoil spring.

2. The system of claim 1, further comprising an end of stroke resilient buffer.

3. The system of claim 2, wherein the buffer includes a spring.

4. The system of claim 1, further comprising a charging handle engaging the actuator to manually cycle the action.

5. The system of claim 4, wherein the charging handle extends rearwardly of the actuator.

6. The system of claim 4, wherein the charging handle extends laterally of the actuator.

7. The system of claim 6, wherein the charging handle can reversibly extend to either side of the actuator.

8. The system of claim 1, wherein the guide rod includes a rear end member that captures a rear end of the recoil spring.

9. The system of claim 8, further comprising a retainer member at a forward end of the guide rod to capture the release component, forward abutment, and recoil spring against the rear end member.

10. The system of claim 1, wherein the guide rod recess comprises an annular groove.

11. The system of claim 1, wherein the at least one recess is adjacent a forward end of the guide rod.

12. The system of claim 11, wherein the recess comprises an annular groove.

13. The system of claim 1, wherein the release component includes an interior roller pocket.

14. The system of claim 13, wherein the interior roller pocket is annular.

15. The system of claim 1, wherein the bolt body includes a longitudinal slot configured to receive at least a portion of the actuator.

16. The system of claim 15, wherein the slot has a length, the length limiting longitudinal movement of actuator relative to the bolt body.

17. The system of claim 1, wherein the actuator includes a sleeve slidably positioned around at least a portion of the bolt body and configured to engage with the release component of the recoil spring/buffer system.

18. The system of claim 17, wherein the sleeve includes a forwardly directed operating connection portion.

19. The system of claim 1, comprising a plurality of rollers.

20. The system of claim 19, comprising at least four rollers.

21. The system of claim 1, wherein the force required to displace the release component and forward abutment when the bolt body applies rearward force against the forward abutment to disengage the roller from the recess is relatively higher than the force required to displace the release component and forward abutment when the release component is displaced first by manual cycling to disengage the roller from the recess.

22. A manual release roller delayed recoil spring/buffer system for an autoloading firearm action having a blow-back bolt, comprising:

an actuator, the actuator being manually longitudinally movable relative to the bolt; and a recoil spring/buffer system comprising:

a longitudinal guide rod having at least one recess;

a release component and a forward abutment slidably arranged together on the guide rod;

a recoil spring on the guide rod configured to bias the release component forwardly; and at least one roller body arranged between the release component and the forward abutment such that when the roller body is engaged in the guide rod recess, the release component and forward abutment are longitudinally slidably detained relative to the guide rod, wherein manual rearward sliding movement of the actuator causes displacement of the release component relative to the forward abutment such that the at least one roller disengages from the guide rod recess to allow undetained rearward sliding movement of the release component and forward abutment against the recoil spring.

23. The system of claim 22, further comprising a charging handle engaging the actuator for manually cycling the action.

24. The system of claim 22, wherein the force required to displace the release component and forward abutment when the bolt body applies rearward force against the forward abutment to disengage the roller from the recess is relatively higher than the force required to displace the release component and forward abutment when the release component is displaced first by manual cycling to disengage the roller from the recess.

* * * * *